US005987853A

United States Patent [19]

Dobbs

[11] Patent Number: 5,987,853

[45] Date of Patent: Nov. 23, 1999

[54] BACK SEAL SUPPORT FOR VERTICAL FORM, FILL AND SEAL MACHINE

[75] Inventor: Larence Calvin Dobbs, Greer, S.C.

[73] Assignee: Hayssen, Inc., Duncan, S.C.

[21] Appl. No.: 09/071,978

[22] Filed: May 4, 1998

[51] Int. Cl.[6] ..... B65B 9/06

[52] U.S. Cl. ..... 53/451; 53/551; 53/375.9

[58] Field of Search ..... 53/451, 550, 551, 53/552, 375.9, 375.8; 493/302

[56] References Cited

U.S. PATENT DOCUMENTS

| | | | |
|---|---|---|---|
| 2,385,897 | 10/1945 | Waters | 53/551 |
| 3,538,676 | 11/1970 | Runo | 53/375.9 |
| 4,442,656 | 4/1984 | Wylie | 53/552 |
| 4,630,429 | 12/1986 | Christine | 53/551 |
| 4,646,507 | 3/1987 | Ohlsson et al. | 53/551 |
| 5,067,311 | 11/1991 | Andersson | 53/551 |
| 5,505,040 | 4/1996 | Janssen et al. | 53/551 |

*Primary Examiner*—John Sipos
*Attorney, Agent, or Firm*—Lee, Mann, Smith, McWilliams, Sweeney & Ohlson

[57] ABSTRACT

A method and apparatus for use in a vertical form, fill and seal machine to protect the longitudinal back seal. A pair of clamps retains the plastic film against the forming tube on either side of the back seal and on either side of a sealing platen if the platen is used for forming the back seal. The clamps extend for at least the length of the platen, and the clamps are operated together in unison.

11 Claims, 3 Drawing Sheets

BACK SEAL SUPPORT FOR VERTICAL FORM, FILL AND SEAL MACHINE

BACKGROUND OF THE INVENTION

This invention relates to vertical form, fill and seal machines, and in particular to a method and apparatus for protecting the back seal formed by the vertical form, fill and seal machine as product to be packaged is inserted.

For years, vertical form, fill and seal machines have been used to package various products by forming plastic film around a forming tube, making a back seal in plastic film while it is on the forming tube in order to form the plastic into a generally cylindrical shape, and then inserting product to be packaged by dropping it down the forming tube into partially formed packages before they are finally sealed. Once product is inserted, subsequent operations occur to add end seals which complete the package. Such an apparatus is disclosed in U.S. Pat. No. 4,288,965, the disclosure of which is incorporated herein by reference.

In the typical vertical form, fill and seal machine, when product is inserted down the forming tube, the plastic package is already sealed at its bottom end. Thus, as products fall within the forming tube, some back air pressure is built as products fall down the forming tube, such that back pressure being exerted within the partially-formed package against both the lateral bottom seal in the package and the longitudinal back seal for the package.

When small products are packaged, creation of back pressure is not a problem, since displaced air simply exhausts up the forming tube around the product as it is being dropped into the partially-formed package. However, when the size of the product increases, the back pressure increases and problems can occur. When a large product that nearly equals the diameter of the forming tube is inserted, the product acts like a piston with gravity drawing the product down the forming tube and air in the forming tube being compressed as the product moves downwardly. This can create two detrimental effects. First, the creation of back pressure can retard the velocity of the product, thus limiting the through put of the vertical form, fill and seal machine. Second, increased pressure in the partially-formed package can place excessive strain on both the lateral end seal and the longitudinal back seal of the partially-formed package.

The creation of back pressure is much like the action of a typical shock absorber. The greater the amount of air that can bypass the falling product, the faster the product will fall through the forming tube. Thus, the shape and size of the product being inserted has a considerable affect on the time that it takes the product to drop into the partially-formed package. If the time that the product takes to drop into the partially-formed package varies, this can result in product being trapped in either the final end seal being formed or a stager, if a stager is used to accommodate the weight of the product being inserted. Variability is particularly difficult to control, and product jams are a very undesirable result.

Various means have been developed in the past to try to relieve undesirable back pressure. One method previously utilized was to add vent tubes to the inside of the forming tube in order to exhaust air more efficiently than to simply rely on exhausting air bypassing any gaps between the product and the forming tube. Another possible way to alleviate the problem is to add vent holes to the plastic film, but this typically is unacceptable when a fully sealed package is desired.

Back pressure is not an entirely undesirable effect, since it cushions a product as it drops down the forming tube to help ensure less impact when entering the partially-formed package or impinging upon a stager which is utilized to absorb the impact of the descending product. However, back pressure is undesirable if it affects the quality of either the lateral end seal or the longitudinal back seal of the package.

Generally, when a heavy product, such as a bag filled with liquid, is being inserted down the forming tube, a stager is utilized to absorb the energy of the falling product. Utilization of a stager also greatly reduces the affect of back pressure on the lateral end seal, which is located below the stager. Also, in general, the integrity of the end seal is not a serious concern since typically the sealing pressure for the lateral end seal is higher thus allowing a lower sealing temperature and increased dwell time for the sealing jaws as compared to the platen with lower pressure, higher sealing temperature, and shortened dwell time used for the longitudinal back seal. Also, with the stager protecting the end seal, the back seal is typically the area where problems of integrity of the seal occur. Protecting the back seal is the primary object of the present invention.

SUMMARY OF THE INVENTION

The invention is utilized in an apparatus for forming, filling and sealing packages where a web of film is fed over a forming tube to form the film into a generally cylindrical tube about the forming tube, product to be packaged is then inserted into the cylinder, and sealing operations are performed on the cylinder to seal it and form discrete packages. One of the sealing operations comprises forming the back seal by sealing overlapping longitudinal side edges of the film after the cylinder is formed about the forming tube. Means is provided for retaining the film against the forming tube on opposite sides of the overlapping longitudinal side edges of the film in order to prevent movement of the film when it is retained.

In accordance with the preferred form of the invention, the retaining means comprises at least two clamps, with one clamp being located on each side of the longitudinal side edges of the film forming the back seal. The clamps are spaced from one another, and if a sealing platen is used for sealing the overlapping longitudinal side edges, the clamps are located on opposite sides of the sealing platen. The clamps extend for at least the length of the sealing platen, and the clamps are operated in unison, independent of the operation of the sealing platen.

In accordance with the method of the invention, the film is retained against the forming tube on opposite sides of the overlapping longitudinal side edges, the sealing operation for sealing the overlapping longitudinal side edges is performed, and the film is then released prior to advancing the film along the forming tube. The clamps are used for retaining the film, and are operated in unison. Preferably, retention of the film is such as to prevent air from entering between the film and the forming tube.

BRIEF DESCRIPTION OF THE DRAWINGS

The invention is described in greater detail in the following description of an example embodying the best mode of the invention, taking in conjunction with the drawing figures, in which.

DESCRIPTION OF AN EXAMPLE EMBODYING THE BEST MODE OF THE INVENTION

Figure 1:
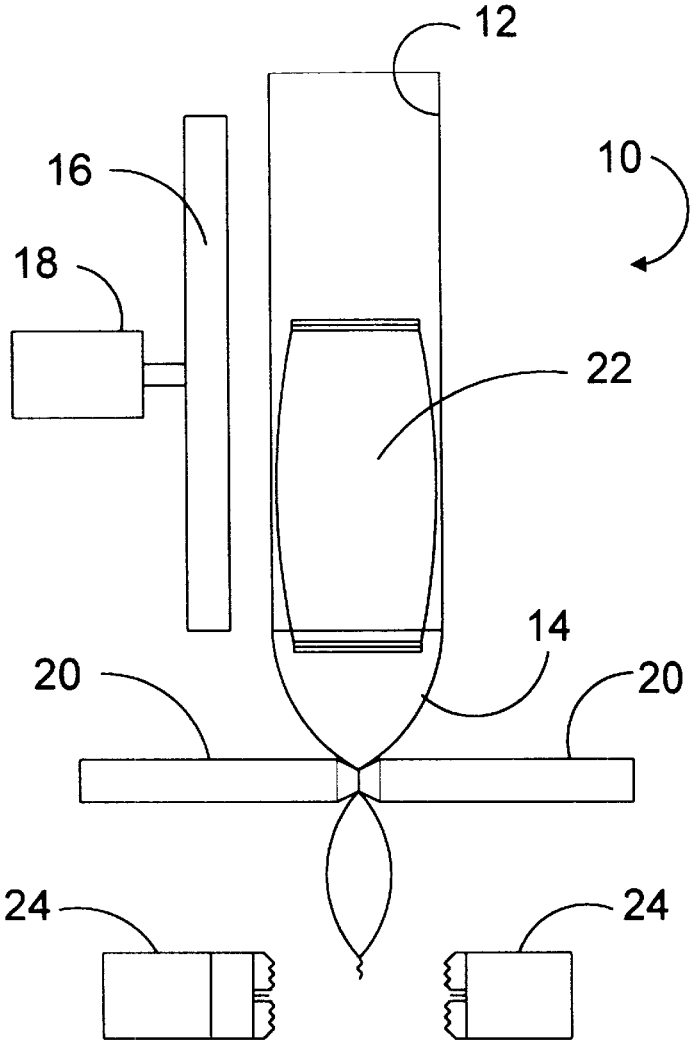
Fig. 1 Prior Art
FIG. 1 schematically illustrates, an elevational form, a vertical form, fill and seal machine wherein a large product, such as a liquid-filled package, is being inserted through the forming tube into a partially-formed package.

Portions of a typical vertical form, fill and seal machine used in connection with the invention of the present application are illustrated generally at 10 in FIG. 1. The machine 10 includes a forming tube 12 about which a plastic film 14 is formed in a cylinder about the forming tube 12. A vertical platen 16, controlled by a platen advance 18, is utilized to form the longitudinal back seal in the film 12. A stager 20 is utilized beneath the forming tube 12 in order to absorb the impact of large products 22, such as a liquid package, which are inserted and fall down the forming tube 12 under the influence of gravity. Sealing and severing jaws 24 are used to form lateral end seals in the plastic film 14 and sever the film into discrete packages.

Not illustrated in FIG. 1 are pull belts utilized for advancing the plastic film along the forming tube, the forming shoulder over which the plastic film is formed into its cylindrical shape, and the source of the plastic film itself and the means for paying out the plastic film. All of the these elements are conventional and are described in greater detail in incorporated U.S. Pat. No. 4,288,965.

Figure 2A:
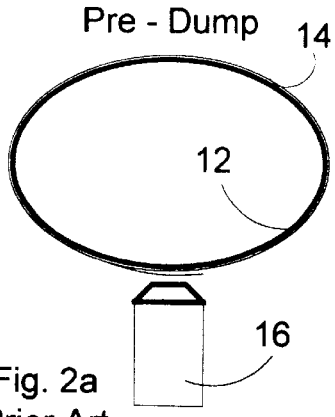
Fig. 2a Prior Art
FIGS. 2*a* through 2*c* illustrate problems that occur, without use of the present invention, when the product is inserted before the sealing platen has advanced.
Figure 2B:
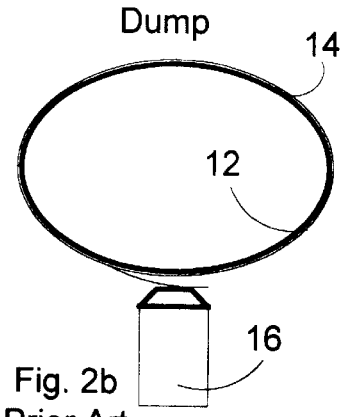
Fig. 2b Prior Art
Figure 2C:
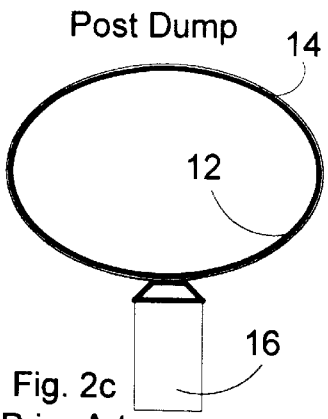
Fig. 2c Prior Art

FIGS. 2*a* through 2*c* illustrate the situation which occurs, prior to utilization of the present invention, where a product 22 is inserted prior to the time that the platen 16 has advanced to form the longitudinal back seal. In FIG. 2*a*, the film 14 has just been advanced along the forming tube 12, with the overlapping side edges of the film 14 in registration with the sealing platen 16. The outer side edge 26 is illustrated.

The product 22 is inserted or "dumped" in the forming tube 12. As the product falls in the forming tube 12, compressed air between the product 22 and the stager 20 builds within the forming tube 12, causing a relatively high pressure. Since the platen 16 has not been advanced, the high pressure escapes between the unsealed edges of the film 14, causing the film to be blown outwardly from the forming tube 12 as shown. The end 26 often touches the platen 16 as shown in FIG. 2*b*, which preheats the film on one side while leaving the opposite side relatively cool. Then, when the platen is advanced as illustrated in FIG. 2*c*, the top layer of the film may actually burn through before the platen is actually in sealing contact with the film and the forming tube. This is particularly unacceptable if the film 14 is a thin polyethylene which melts easily if it is not pressed against the heat sink provided by the forming tube 12 during the normal sealing operation. The sealing operation has three primary variables—time, temperature and pressure. Since the pressure is limited by the strength of the forming tube, this requires increased sealing temperature or dwell time. Since dwell time is usually restricted, temperature must be increased which increases the possibility of burn through of the film, especially in thin polyethylene materials.

Another problem that occurs as a function of back pressure, although not illustrated in FIGS. 2*a* through 2*c* (but illustrated in FIGS. 3 and 4) is that back pressure within the forming tube 12 causes the film 14 to balloon outwardly from the forming tube 12, causing the package to be slightly larger in diameter with less lap to the back seal than originally designed. If the back seal is too small, a back seal gap failure can occur.

Figure 3A:
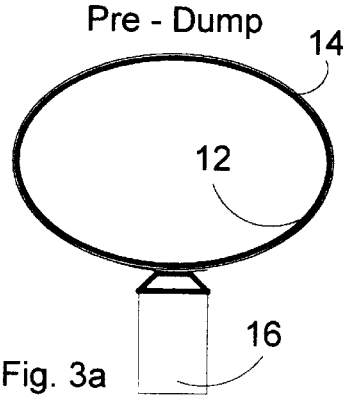
Fig. 3a Prior Art
FIGS. 3*a* through 3*c* illustrate problems which occur, without use of the present invention, when a product is dropped during the time that the platen is sealing the longitudinal back seal.
Figure 3B:
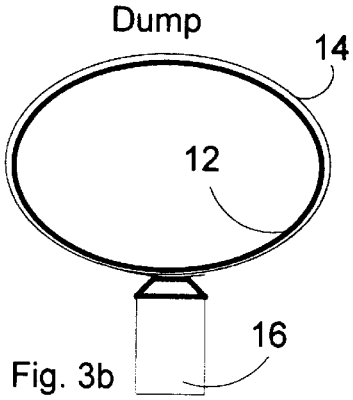
Fig. 3b Prior Art
Figure 3C:
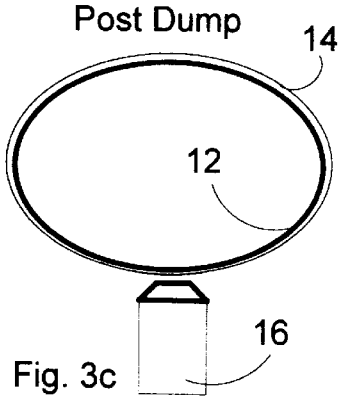
Fig. 3c Prior Art

FIGS. 3*a* through 3*c* illustrate a situation similar to FIGS. 2*a* through 2*c*, but where the platen 16 is advanced prior to the time that the product 22 is inserted into the forming tube 12. In FIG. 3*a*, the longitudinal sealing operation by the platen 16 has begun, and FIG. 3*b* illustrates the situation where the product has been inserted into the forming tube 12 during the sealing operation. In this instance, the seal is not completed, and the back pressure within the forming tube 12 causes the film 14 to be blown away from the tube 12, stretching the molten film of the longitudinal back seal and decreasing the thickness of the film in the area abutting the seal, as well as ballooning the film 14 outwardly from the forming tube 12 as shown. In FIG. 3*c*, the sealing is completed and the platen 16 has been retracted, but the film 14 continues to have a larger diameter than the outer diameter of the forming tube 12 due to the film stretch adjacent to the seal.

In this instance, not only is the diameter of the package undesirably increased, but because of stretching in the area of the longitudinal back seal, the thickness of the material is diminished. Thinning of the plastic film 14 can be undesirable and lead to failure of the package along the back seal.

Figure 4A:
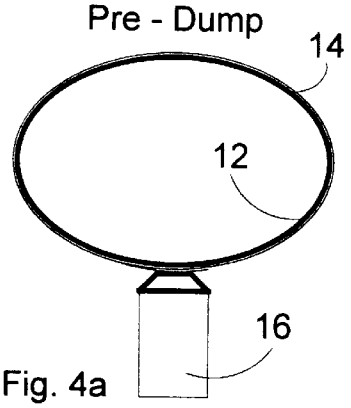
Fig. 4a Prior Art
FIGS. 4*a* through 4*c* illustrate problems which occur, without use of the present invention, when the product is inserted after the back seal has been formed and the longitudinal back seal is in the process of cooling.
Figure 4B:
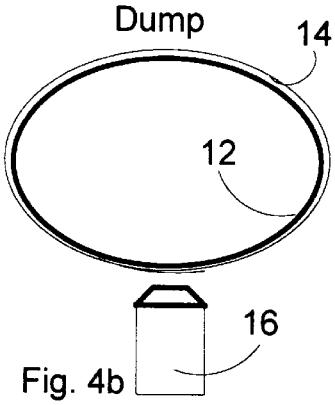
Fig. 4b Prior Art
Figure 4C:
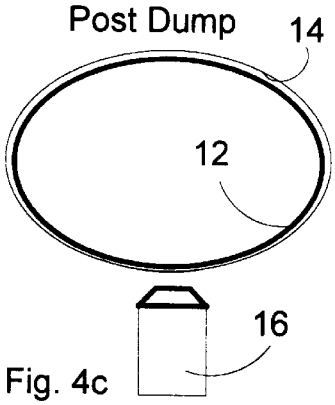
Fig. 4c Prior Art

FIGS. 4*a* through 4*c* illustrate the situation similar to FIGS. 3, except that the longitudinal back seal is completed prior to the time that the product 22 is inserted in the forming tube 12. In FIG. 4*a*, the process of forming the longitudinal back seal is depicted. In FIG. 4*b*, the platen 16 has been retracted, and the product 22 has been inserted in the forming tube 12, causing back pressure. Because the back seal is still molten, the back pressure causes the film 14 to stretch in the area of the longitudinal back seal, ballooning the film 14 outwardly from the forming tube 12 as illustrated. The stretch is permanent after the seal cools, as illustrated in FIG. 4*c*, even after the product 22 is fully inserted within the partially-formed package.

Similar to the situation in FIGS. 3, the package formed in the FIGS. 4 sequence is larger in diameter than desired, and also stretching of the plastic film 14 in the vicinity of the longitudinal back seal results in diminished film strength in the seal area. Normally, this is an undesired result.

Therefore, without some means of protecting the back seal, no matter when the product is inserted into the partially-formed package, an ill-formed package has normally been the result. Not only are such packages larger than desired, but weak back seals, leaking back seals, incomplete back seals, back seal gaps and bum through in the back seal are the typical result previously experienced.

Figure 5:
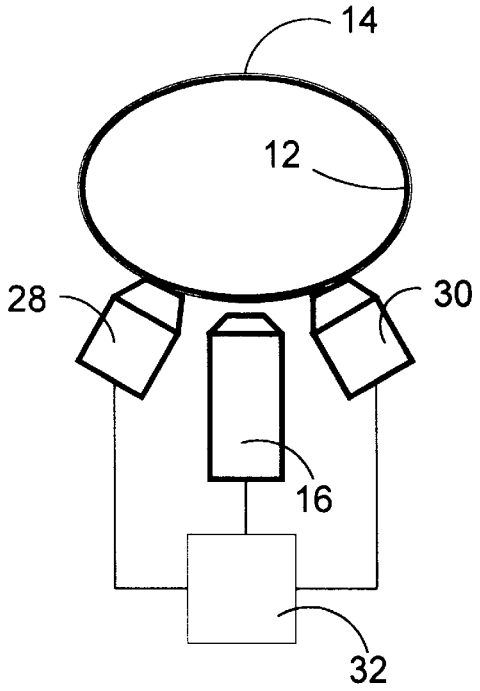
FIG. 5 illustrates one form of protecting the back seal, in accordance with the invention.

Turning to FIG. 5, illustrated is a solution to the problems previously experienced. A pair of opposite clamps 28 and 30 are employed, one of the clamps 28 and 30 being located on each side of the sealing platen 16. The clamps 28 and 30 are at least as long as the platen 16, and are situated as close as practical to the platen 16 to retain the film 14 against the forming tube 12 on opposite sides of the overlapping longitudinal side edges of the film in order to prevent movement of the film when it is so-retained. A central processor 32, such as a computer, is utilized to both control operation of the clamps 28 and the sealing platen 16. Preferably, the clamps 28 and 30 are operated in unison, independent of operation of the platen 16.

Figure 6:
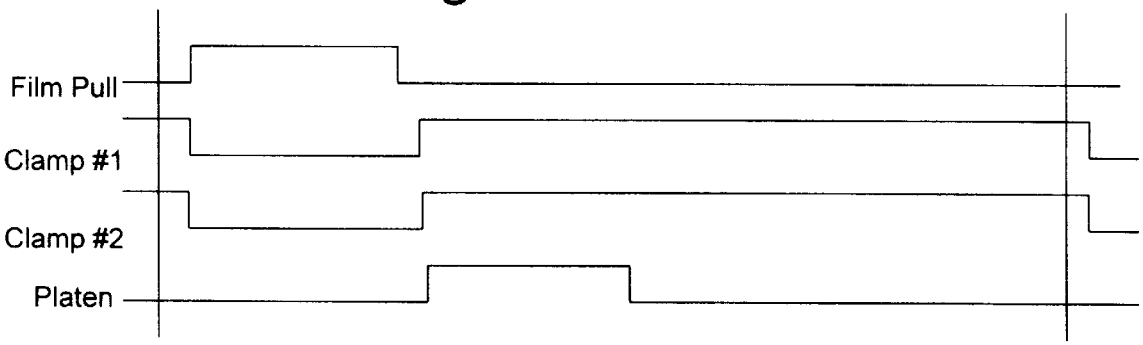
FIG. 6 illustrates the timing of the various elements of the invention, for one product cycle.

A typical cycle is illustrated in FIG. 6. During the time that the film 14 is pulled along the forming tube 12, both of the clamps 28 and 30 are released. Immediately after the film pull has stopped, the clamps 28 and 30 are activated to clamp the film 14 against the forming tube 12. At about the same time, the platen 16 is advanced to form the longitudinal back seal in the film 14. During this time, or after the seal has been completed, the product 22 is inserted in the forming tube 12. However, the clamps 28 and 30 remain in place, clamping the film 14 against the forming tube 12. Therefore, any back pressure created in the forming tube 12 by the falling product 22 cannot affect the integrity of the longitudinal back seal, even after the platen 16 is retracted and the back seal is cooling. Once the product 22 is seated in the partially-formed package, the clamps at 28 and 30 can be opened, and the film 14 again advanced, with the cycle then being repeated.

Due to employment of the clamps 28 and 30, all of the problems experienced in prior art designs are alleviated. Weak back seals, due either to bum through of the back seal or stretching of the seal material, cannot occur. Leaking back seals do not occur, nor can incomplete back seals result. Billowing of the film 14 about the forming tube 12 between the clamps 28 and 30 in the sealing area is impossible, and therefore an undesirable increase in the package size does not occur.

Utilization of the clamps 28 and 30 permits the formation of a desired package, independent of the time at which the product 22 is inserted within the forming tube 12. In the example of FIGS. 3, with the clamps 28 and 30 in place, escaping air cannot escape through the open back seal and therefore the loose end 26 cannot prematurely impinge upon the platen 16. In the example of FIGS. 4, with the clamps 28 and 30 in place, air pressure does not impinge on the molten back seal, and the seal cannot stretch. Also, the film 14 cannot balloon away from the tube 12 in the sealing area. Similarly, in the example of FIGS. 4, with the clamps 28 and 30 in place after the sealing platen 16 has been retracted, the gelatinous back seal is permitted to solidify completely after the platen retracts while the product 22 falls through the forming tube 12. Again, no stretching of the seal or ballooning of the film 14 is possible in the sealing area.

Various changes can be made to the invention without departing from the spirit thereof or scope of the following claims.

What is claimed is:

1. In an apparatus for forming, filling and sealing packages wherein a web of film is fed over a forming tube to form the film into a cylinder about the forming tube, product to be packaged is inserted into the cylinder, and sealing operations are performed on the cylinder to seal it and form discrete packages, and wherein one of the sealing operations comprises sealing overlapping longitudinal side edges of the film with a longitudinal sealer after the cylinder is formed about the forming tube, the improvement comprising means for retaining the film against the forming tube on opposite sides of the overlapping longitudinal side edges of the film circumferentially immediately adjacent to the longitudinal sealer and extending at least the length of the sealer to prevent movement of the film during the sealing operation.

2. An apparatus according to claim 1 in which said retaining means comprises at least two clamps, one clamp being located on each side of the longitudinal side edges of the film.

3. An apparatus according to claim 2 in which said clamps are spaced from one another.

4. An apparatus according to claim 2 in which the longitudinal sealer comprises a sealing platen for sealing the overlapping longitudinal side edges of the film, said clamps being located on opposite sides of said sealing platen.

5. An apparatus according to claim 4 in which said platen has a predetermined length and said clamps extend for at least said predetermined length.

6. An apparatus according to claim 4 in which said sealing platen and said clamps operate independently of one another.

7. An apparatus according to claim 2 including means for operating said clamps in unison.

8. In an apparatus for forming, filling and sealing packages wherein a web of film is fed over a forming tube to form the film into a cylinder about the forming tube, product to be packaged is inserted into the cylinder, and sealing operations are performed on the cylinder to seal it and form discrete packages, and wherein one of the sealing operations comprises sealing overlapping longitudinal side edges of the film with a longitudinal sealer after the cylinder is formed about the forming tube, a method for retaining the film to prevent movement of the film when retained, comprising a. retaining the film against the forming tube on opposite sides of the overlapping longitudinal side edges circumferentially immediately adjacent to the longitudinal sealer and extending along at least the length of the sealer, b. performing the sealing operation of sealing the retained longitudinal side edges of the film, and c. releasing the film prior to advancing the cylinder along the forming tube.

9. The method according to claim 8 in which method step "a" includes retaining the film with at least two clamps with one clamp being located on each side of the longitudinal side edges of the film.

10. The method according to claim 9 including operating of the clamps in unison.

11. The method according to claim 8 in which method step "a" includes retaining the film against the forming tube to prevent air from entering between the film and the forming tube.

* * * * *